United States Patent [19]

Abodishish et al.

[11] 4,374,806

[45] Feb. 22, 1983

[54] RAFFINATE WASH OF SECOND CYCLE SOLVENT IN THE RECOVERY OF URANIUM FROM PHOSPHATE ROCK

[75] Inventors: Hani A. Abodishish; Robert W. Ritchey, both of Lakeland, Fla.

[73] Assignee: Wyoming Mineral Corporation, Lakewood, Colo.

[21] Appl. No.: 160,245

[22] Filed: Jun. 17, 1980

[51] Int. Cl.[3] ..... C01G 56/00; B01D 11/00

[52] U.S. Cl. ..... 423/10; 423/8; 423/15

[58] Field of Search ..... 423/11, 10, 15, 8

[56] References Cited

U.S. PATENT DOCUMENTS 3,737,513 6/1973 Wiewiorowski et al. ..... 423/8

4,105,741 8/1978 Wiewiorowski et al. ..... 423/10

*Primary Examiner*—Robert Gerstl

*Attorney, Agent, or Firm*—D. P. Cillo

[57] ABSTRACT

Precipitation of $Fe_3HN_4H_8(PO_4)_6$ is prevented in the second cycle extractor, in a two cycle uranium recovery process, by washing ammonia laden organic solvent stream, from the second cycle stripper, with first cycle raffinate iron stream containing phosphoric acid, prior to passing the solvent stream into the second cycle extractor.

6 Claims, 1 Drawing Figure

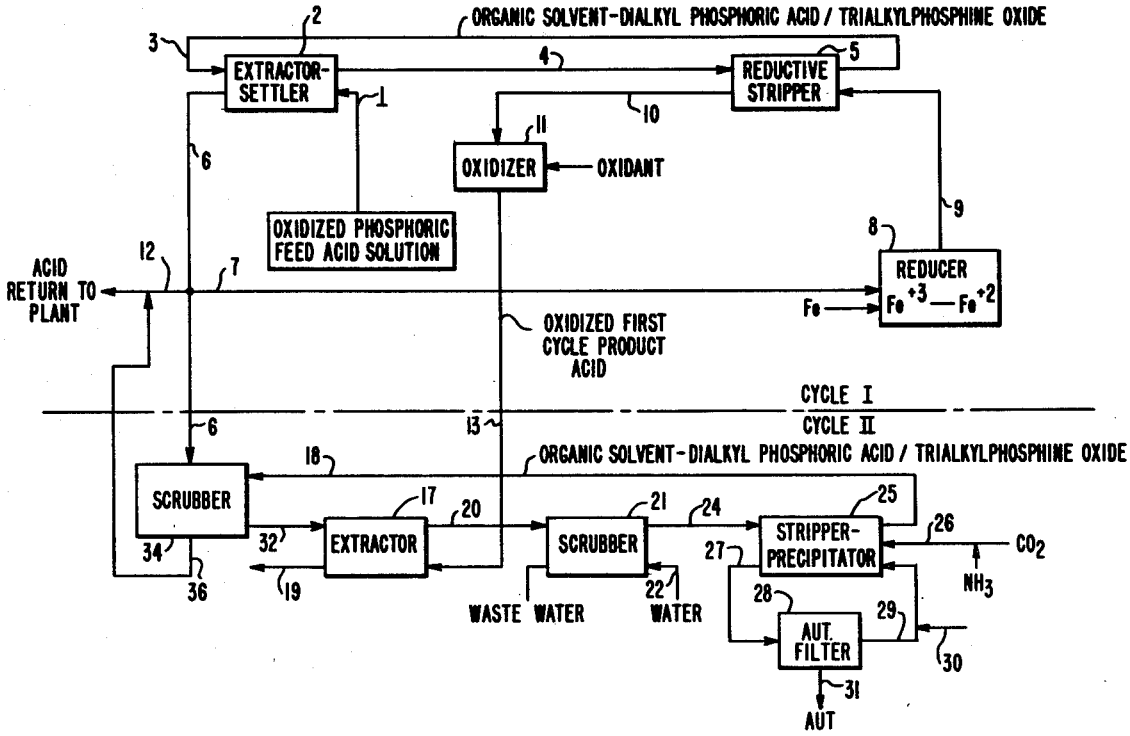

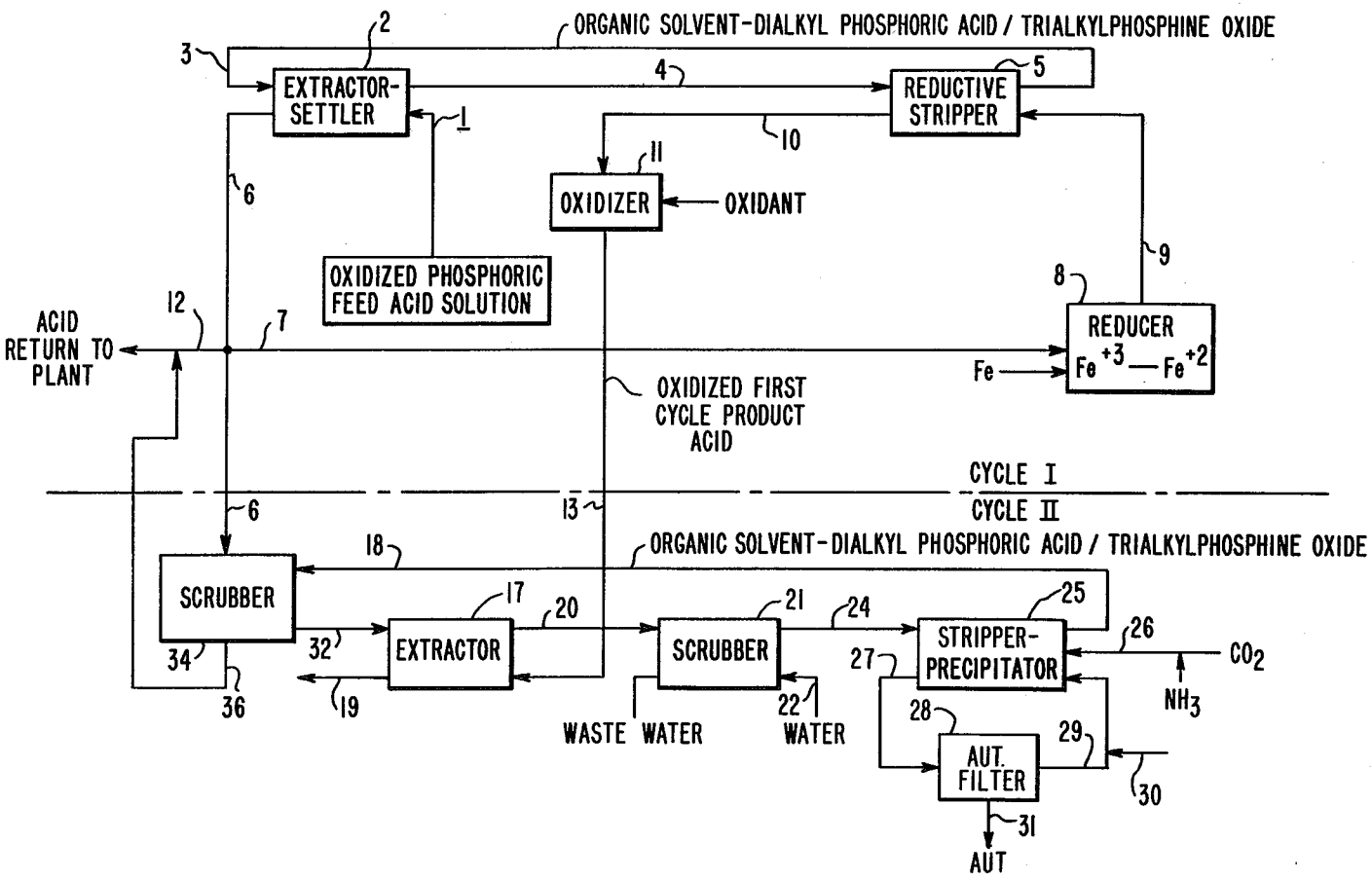
ORGANIC SOLVENT-DIALKYL PHOSPHORIC ACID / TRIALKYLPHOSPHINE OXIDE
REDUCTIVE STRIPPER
REDUCER
Fe+3 — Fe+2
Fe
OXIDANT
OXIDIZER
OXIDIZED FIRST CYCLE PRODUCT ACID
OXIDIZED PHOSPHORIC FEED ACID SOLUTION
EXTRACTOR-SETTLER
ACID RETURN TO PLANT
CYCLE I
CYCLE II
ORGANIC SOLVENT-DIALKYL PHOSPHORIC ACID / TRIALKYLPHOSPHINE OXIDE
CO2
NH3
STRIPPER-PRECIPITATOR
AUT. FILTER
AUT
WATER
SCRUBBER
WASTE WATER
EXTRACTOR
SCRUBBER

RAFFINATE WASH OF SECOND CYCLE SOLVENT IN THE RECOVERY OF URANIUM FROM PHOSPHATE ROCK

BACKGROUND OF THE INVENTION

Presently, uranium is being recovered from phosphoric acid by solvent extraction. In the first cycle of preferred processes using a di-2-ethylhexylphosphoric acid/trialkylphosphine oxide (D2EHPA/TOPO) solvent mixture, the uranium is stripped from the solvent using phosphoric acid containing a high concentration of ferrous iron. The uranium can be recovered from this strip acid by first oxidizing the acid and then re-extracting the uranium, preferably with a D2-EHPA/TOPO solvent mixture in a second cycle extraction. The uranium can be recovered from the second cycle solvent using an ammonium carbonate strip solution. This process is well known in the art, and is taught for example by Hurst et al., in U.S. Pat. No. 3,711,591; Elikan et al., in U.S. Pat. No. 3,966,873 and Sundar, in U.S. Pat. No. 4,002,716.

In this second cycle operation, uranium stripped organic is recycled back to re-extract more uranium from the oxidized first cycle product acid. However, an iron-ammonium-phosphate precipitate is formed. The precipitate has been identified as primarily $Fe_3NH_4H_8(PO_4)_6$. Wiewiorowski et al., in U.S. Pat. No. 4,105,741, dealing primarily with iron removal from phosphoric acid, also recognized this problem. Wiewiorowski et al. attempted to eliminate this precipitate, which interferes with uranium recovery, by washing the second cycle solvent with an outside stream of a purified acid selected from sulfuric, hydrochloric, nitric or iron-free phosphoric acid. However, this requires a large supply of expensive, pure acid, and requires a disposal of the partially neutralized acid. What is needed is an inexpensive means to eliminate the precipitate.

SUMMARY OF THE INVENTION

The above problems are solved, and the above needs are met by contacting the ammonia laden, organic, second cycle solvent stream with first cycle raffinate wet process phosphoric acid in a scrubbing means. This scrubbing will occur after the second cycle solvent exits the stripper means and before the second cycle solvent reenters the extractor means. The washed, ammonia barren solvent can then be circulated to extract uranium from the oxidized acid in either but preferably in the second cycle extraction with minimum precipitation of $Fe_3NH_4H_8(PO_4)_6$. The partially ammoniated, first cycle raffinate acid may then be returned to the raffinate acid exit stream where it is further processed to make fertilizer products. It has been found that the iron present in the raffinate does not hinder treatment of the second cycle solvent, and so allows use of the inexpensive unpurified phosphoric acid raffinate which is readily available in the uranium recovery system.

BRIEF DESCRIPTION OF THE DRAWINGS

For a better description of the invention, reference may be made to the preferred embodiments exemplary of the invention, shown in the accompanying drawing, which shows a flow diagram, illustrating one example of a process for first and second cycle stripping of uranium from a wet process phosphoric acid feed.

DESCRIPTION OF THE PREFERRED EMBODIMENTS

Referring to the drawing, in Cycle I, purified phosphoric feed acid from line 1 enters extractor-settler means 2, which may contain 1 to 6 stages. This feed from domestic phosphate is typically a 35° C. to 50° C. aqueous 5 to 6 M solution of wet process phosphoric acid having a pH of about 0.1 to about 2.5, and containing about 0.1 to about 0.5 g/l of uranium (as the uranyl ion, $UO_2^{+2}$), about 600 g/l of phosphate and about 3 to 15 g/l of iron. Some foreign phosphate deposits may provide a raffinate containing about 3 g/l of iron. In the process shown, the phosphoric acid may be oxidized by any suitable means, to ensure that the uranium is in the +6 oxidation state, i.e., uranyl ion. In the extractor-settler, the feed acid is contacted by mixing with a water-immiscible, organic extractant composition from line 3. The extractant solvent composition contains a reagent which extracts the uranyl ions to form a uranium complex soluble in the organic solvent.

Typically, the solvent composition from line 3 is added in a 0.5 to 1 solvent to phosphoric feed acid ratio (by volume). The solvent composition from line 3 contains about 0.2 to 0.7 mole of a di-alkyl phosphoric acid additive having about 4 to 10 carbon atoms in each chain, preferably di-2-ethylhexyl phosphoric acid (D2EHPA) per liter of solvent. The solvent also contains about 0.025 to about 0.25 mole of a synergistic additive agent well known in the art, for example, a trialkylphosphine oxide, where the alkyl chains are linear from $C_4$ to $C_{10}$, preferably tri-n-octylphosphine oxide (TOPO) per liter of solvent. These synergistic agents allow reduction of equipment size while increasing uranium extraction. The solvent is usually kerosine. The use of the term "solvent stream" herein is meant to include such additives as described above. While the description herein is primarily directed to D2EHPA/-TOPO mixtures, it is to be understood that broader di-alkyl phosphoric acid/trialkylphosphine oxides are included.

The solvent stream, containing complexed uranium, passes through line 4 to reductive stripper means 5, which may contain 1 to 4 stages, to strip uranium from the organic solvent. A portion of the raffinate exiting extractor 2 passes through line 7 to reducer 8 where iron (Fe°) is added to reduce enough ferric ions to bring the ferrous ion concentration up to a level sufficient to reduce the uranyl ion to the $U^{+4}$ ion. The ferrous ion enters reductive stripper 5 by line 9 and is oxidized there to the ferric ion, while reducing the uranyl ion to the quadravalent $U^{+4}$ ion, which is transferred to the aqueous stream strip solution in line 10. The organic solvent leaving the stripper is then recycled through line 3 to extractor 2.

Finally, the $U^{+4}$ ion in the strip solution in line 10 is oxidized to the uranyl ion in oxidizer 11, to enable the uranium to be extracted again in Cycle II. The product from Cycle I contains phosphoric acid and typically has a pH of about 0.1 to 2.5. It contains about 25 g/l to 40 g/l of iron, and about 3 g/l to 15 g/l of uranium. An appropriate portion of the first cycle raffinate acid is fed into Cycle II by line 6. The remainder of the raffinate exits by line 12.

CYCLE II

The oxidized aqueous liquor solution in line 13 contains uranium in the hexavalent state i.e., the uranyl ion.

The aqueous liquor passes through line 13 to liquid-liquid solvent extractor 17. The aqueous liquor is mixed with a water-immiscible, organic solvent stream from line 32, which reacts with the uranyl ions in the liquid to form a complex soluble in the solvent. This second cycle solvent stream from line 18 is washed in scrubbing means 34, as described below, to prevent precipitation of $Fe_3NH_4H_8(PO_4)_6$ in the extractor 17.

This solvent stream 32 is generally the same as that of feed line 3, i.e., preferably about 0.2 to 0.7 mole of dialkyl phosphoric acid additive, well known in the art, having 4 to 10 carbon atoms in each chain, preferably di-2-ethylhexyl phosphoric acid (D2EHPA) per liter of solvent. The solvent stream also contains about 0.025 to about 0.25 mole of a synergistic additive agent well known in the art, for example, a trialkylphosphine oxide, where the alkyl chains are linear from $C_4$ to $C_{10}$, preferably tri-n-octylphosphine oxide (TOPO) per liter of solvent. Ammonia present in the solvent stream of line 18 will be removed in scrubbing means 34, as described below, to provide the ammonia barren stream 32. Typically, the volume ratio of solvent stream:aqueous liquor fed into the second cycle extractor is about 1:4 to 1.

The organic solvent stream, containing complexed uranium, leaves extractor 17 through line 20. The organic solvent-acid in line 20 may be scrubbed with water in scrubber 21 to remove any acid entrainment which would increase the ammonia consumption in the stripper-precipitator 25. Water enters scrubber 21 by line 22 and waste water leaves by line 23. The organic solvent then passes through line 24 to stripper 25.

In the stripper 25, the organic solvent stream is stripped with an aqueous solution containing enough ammonium compounds, such as ammonium carbonate, ammonium bicarbonate, or a mixture thereof from line 26 to precipitate a uranium complex from the organic phase. The preferred uranium complex is AUT as it is easy to filter. The organic solvent stream is recycled through line 18. The aqueous slurry containing the precipitated AUT passes through line 27 to AUT filter 28 where AUT is filtered off.

The filtrate is recycled through line 29 to stripper-precipitator 25. A 0.5 M ammonium carbonate solution is added to line 29 as needed from line 30 to make up for water losses. The precipitated AUT can be calcined in an oven at about 350° C. to about 900° C. which drives off carbon dioxide and ammonia. If the calcining is done in a reducing atmosphere, such as a hydrogen-nitrogen mixture, $UO_2$ is obtained and collected. If the calcining is done in an oxidizing atmosphere, such as air, the mixed oxide $U_3O_8$ is obtained and collected.

In the second cycle organic solvent-dialkyl phosphoric acid/trialkylphosphine oxide wash step, central to this invention, an ammonia laden second cycle solvent stream from line 18, i.e., uranium barren solvent-dialkyl phosphoric acid/trialkylphosphine oxide contacted with ammonium carbonate, and containing about 5 to about 10 grams per liter of ammonium ion, is washed in scrubber means 34, with first cycle raffinate, iron containing phosphoric acid from line 6. The volume ratio of the ammonia laden second cycle solvent stream:first cycle raffinate acid is from about 1:0.2 to 0.5. Over 0.5 and the system will start to become acid continuous instead of organic continuous and an emulsion will form hindering extraction. Under 0.2 and the ammonia will not be effectively neutralized. This range is critical to providing substantially ammonia barren organic solvent-D2EHPA/TOPO, feed into the extractor.

In the scrubber means 34, the ammonia passes from the organic solvent stream to the aqueous acid phase, transferring to the phosphoric acid raffinate. The organic phase, which is immiscible in the aqueous phase, is then fed into the extractor. In this invention, wet process phosphoric acid raffinate is used, containing from about 3 to 15 grams per liter of iron, rather than chemically pure phosphoric acid. It has been found that the iron present does not hinder washing the second cycle solvent stream and allows use of inexpensive raffinate already in the system. The washed second cycle solvent stream exits as line 32, which can then be used in the extractor 17, without forming any substantial amounts of $Fe_3NH_4H_8(PO_4)_6$ precipitate. The partially ammoniated first cycle acid exits as line 36 which is returned to the main acid exit stream where it is returned to the plant and further processed to make fertilizer. The use of first cycle raffinate is especially effective for this washing step since it is low in contaminating organics and low in uranium. It is effective to remove from 95 to 99 wt. % of the ammonium ions present in the ammonia laden solvent-dialkylphosphoric acid/trialkylphosphine oxide, preferably solvent-D2EHPA/TOPO, stream 18.

EXAMPLE 1

The second cycle of a uranium recovery process was modified as shown in the drawing, so that second cycle extractant, comprising ammonia laden di-2-ethyhexylphosphoric acid and tri-n-oxtylphosphine oxide in kerosene solvent, fresh from the second cycle strip mixer settler, was piped into a scrubber tank. About 0.50 mole of D2EHPA and 0.125 mole of TOPO was present per liter of kerosene. The ammonia laden organic contained about 9 grams per liter of ammonium ion. In the scrubber tank, the second cycle organic extractant was mixed with first cycle raffinate phosphoric acid, containing about 10 grams per liter of iron, to provide ammonia free solvent-acid. The volume ratio of ammonia laden second cycle solvent-D2EHPA/TOPO:first cycle raffinate acid was 1:0.3. This, washed, ammonia free extractant was then fed into the second cycle extractor means, where it extracts uranium from the oxidized acid from Cycle I. The uranium was then stripped with ammonium-uranyl-tricarbonate.

Prior to installation of the separate scrubbing tank, the quantity of $Fe_3NH_4H_8(PO_4)_6$ precipitate formed in the second cycle extractor means averaged 60 lb./hr. After installation of the scrubbing tank, the quantity of $Fe_3NH_4H_8(PO_4)_6$ solids was reduced to about 10 lb./hr. for the same flow rates of all the materials. This indicated that very little ammonia was back extracted, that the iron in the raffinate did not hinder scrubbing, and that about 97 wt. % of ammonium ion was removed from the ammonia laden solvent-D2EHPA/TOPO in the ammonia neutralization scrubber.

We claim:

1. In the process of recovering uranium from an aqueous solution of wet process phosphoric acid feed, comprising a first and a second cycle, where phosphoric acid is passed through extractor means and stripper means in both cycles and where a phosphoric acid raffinate containing about 3 grams to about 15 grams per liter of iron exits the extractor means in the first cycle; the improvement comprising treating a second cycle ammonia laden organic solvent stream to remove ammonia therefrom, after said solvent has passed through a second cycle stripper means and contacted ammonium compounds, said treating consisting of scrubbing said second cycle ammonia laden organic solvent stream in the second cycle, with first cycle phosphoric acid raffinate containing about 3 grams to about 15 grams per liter of iron, from the first cycle extractor means, in an amount effective to remove ammonia, to provide an ammonia barren organic solvent stream which is then fed into the second cycle extractor means without forming any substantial amounts of iron-ammonium-phosphate precipitate, where the volume ratio of the second cycle ammonia laden organic solvent stream:first cycle iron containing phosphoric acid raffinate stream from the first cycle extractor means is from 1:0.2 to 0.5.

2. The method of claim 1, wherein the second cycle ammonia laden organic solvent stream contains about 5 to about 10 grams per liter of ammonium ion before scrubbing, said scrubbing being effective to remove from 95 to 99 wt. % of the ammonium ions.

3. The method of claim 1, wherein the second cycle ammonia laden organic solvent stream contains a dialkyl phosphoric acid having 4 to 10 carbon atoms in each chain and a trialkylphosphine oxide, where the alkyl chains are linear from $C_4$ to $C_{10}$.

4. The method of claim 1, wherein the second cycle ammonia laden organic solvent stream consists of di-2-ethylhexyl phosphoric acid and tri-n-octylphosphine oxide in kerosine solvent.

5. The method of claim 1, including the step of feeding the ammonia baren organic solvent stream into a second cycle extractor, to contact a stream of oxidized phosphoric acid and ammonium-uranyl-tricarbonate mixture.

6. The method of claim 5, where the volume ratio of the solvent stream:oxidized acid plus ammonium-uranyl-tricarbonate stream is about 1:0.5 to 1.

* * * * *